166-308 SR
5/19/87 XR 4,665,984

United States Patent [19]
Hayashi et al.

[11] Patent Number: 4,665,984
[45] Date of Patent: May 19, 1987

[54] METHOD OF MEASURING CRUSTAL STRESS BY HYDRAULIC FRACTURE BASED ON ANALYSIS OF CRACK GROWTH IN ROCK

[75] Inventors: Kazuo Hayashi; Tetsuo Shoji; Hiroaki Niitsuma; Hideaki Takahashi; Hiroyuki Abe, all of Sendai, Japan

[73] Assignee: Tohoku University, Sendai, Japan

[21] Appl. No.: 896,218

[22] Filed: Aug. 14, 1986

[30] Foreign Application Priority Data

Aug. 29, 1985 [JP] Japan ..... 60-190221

[51] Int. Cl.[4] ..... E21B 43/26; E21B 47/02; E21B 47/06

[52] U.S. Cl. ..... 166/250; 73/784; 166/308

[58] Field of Search ..... 166/250, 254, 255, 308; 73/151, 155, 784, 799, 783

[56] References Cited

U.S. PATENT DOCUMENTS

| | | | |
|---|---|---|---|
| 3,586,105 | 6/1971 | Johnson et al. | 166/250 |
| 3,739,781 | 6/1973 | Bailey | 166/250 X |
| 3,796,091 | 3/1974 | Serata | 73/784 |
| 3,992,928 | 11/1976 | Thoms | 73/784 |
| 4,005,750 | 2/1977 | Shuck | 166/308 |
| 4,044,828 | 8/1977 | Jones et al. | 166/250 X |
| 4,109,717 | 8/1978 | Cooke, Jr. | 166/250 |
| 4,254,828 | 3/1981 | Sowa | 166/308 |
| 4,291,581 | 9/1981 | Jacoby | 73/784 |
| 4,393,933 | 7/1983 | Nolte et al. | 166/250 |
| 4,453,595 | 6/1984 | Lagus et al. | 166/308 X |

*Primary Examiner*—Stephen J. Novosad
*Attorney, Agent, or Firm*—Fleit, Jacobson, Cohn & Price

[57] ABSTRACT

Earth's crustal stress is measured by drilling a bore-hole in rock body, producing a longitudinal crack at a selected portion thereof with or without a natural traverse crack through intermittent application of hydraulic pressure thereat while measuring the pressure at different stages of crack production, producing an artificial traverse cracks through the use of a prenotch, determining orientations of the cracks thus produced by inspecting the bore-hole surface conditions, and numerically analyzing the crack orientations and the pressures at different stages of crack production.

8 Claims, 14 Drawing Figures

METHOD OF MEASURING CRUSTAL STRESS BY HYDRAULIC FRACTURE BASED ON ANALYSIS OF CRACK GROWTH IN ROCK

BACKGROUND OF THE INVENTION

1. Field of the Invention

This invention relates to a method of measuring Earth's crustal stress (to be referred to as "crustal stess", hereinafter) by hydraulically fracturing rock body through the use of a deep bore-hole and analyzing the manner in which the rock body is fractured. More particularly, the invention relates to such technical fields as exploitation of geothermal energy for energy resource development, earthquake prediction, underground stock of petroleum, and nuclear waste disposal.

2. Related Art Statement

Much research and development effort has been made these years in many countries to improve the method of measuring crustal stress, with the purpose of its application to exploitation of geothermal resources, earthquake prediction, disposal of nuclear waste, and underground stroage of petroleum. Since the above application has close relationship with industries and national welfare of any country, there is a widely recognized need for developing advanced techniques in the measurement. In view of such need, large-scale experiments on the measurement of crustal stress are currently undertaken, and studies are made on improvement of conventional methods.

Roughly speaking, there have been two groups of methods for measuring and evaluating crustal stress; namely, (A) stress-release method group, and (B) hydralic fracture method group.

FIG. 12 shows a typical stress-release method of the above group (A). A bore-hole 1 is drilled from the ground surface 4, and an over-coring hole 2 is bored by removing that cylindrical portion of the ground which surrounds the bore-hole 1. The over-coring hole 2 releases the stress, and the magnitude of deformation of the bore-hole 1 due to such stress release is measured by mounting a strain gauge 3 on the bottom surface 1*a* or the sidewall 1*b* of the bore-hole 1. The crustal stress is calculated from the released stress which is measured by the strain gauge 3.

Referring to FIG. 1, in a method of the above group (B), a portion of the bore-hole 1 is selected for the measurement and isolated by blocking the upper and lower ends thereof with packers 5. A hydraulic pressure is introduced to the isolated portion from a water supply system which includes a high-pressure pump 6, so as to effect hydraulic fracture of rock for producing a crack along the sidewall of the bore-hole 1. The crustal stress is determined based on the orientation of the crack thus produced and variation of the hydraulic pressure with elapse of time during the fracture in the isolated portion of the bore-hole.

On the above methods (A) and (B), the use of the methods (A) is limited to the close proximity of the ground surface, because, for deep bore-holes, the strain gauge is hard to mount in position and the output signal from the strain gauge is hard to detect. If a suitable tunnel is available for measuring personnel to reach a deep spot, then the methods (A) may be used as far as such personnel can reach. However, for the depth of several hundreds of meters or deeper, only the methods (B) are applicable.

In the hydraulic fracture methods (B), there are two kinds of cracks to be formed in the isolated section where hydraulic pressure is applied; namely, longitudinal cracks and traverse cracks. The longitudinal cracks are formed in parallel to the length direction of the bore-hole 1 (FIG. 2(*a*)), while the traverse cracks are formed so as to intersect with the bore-hole 1 (FIG. 2(*b*)).

The variation of the hydraulic pressure in the above isolated portion with time elapse is schematically shown in FIG. 3. In the figure, $P_b$ represents the pressure at which opening of a crack is suddenly increased in response to the delivery of high-pressure water to the isolated portion, $P_{sb}$ represents the pressure at which a crack that is once closed upon halting of high-pressure water supply is reopened after resuming high-pressure water supply, and $P_s$ represents the pressure when the water supply system is shut in. In the ensuing description, $P_b$ will be called the breakdown pressure, $P_{sb}$ will be called the crack reopening pressure, and $P_s$ will be called the shut-in pressure.

There are three types in the above methods (B) from the standpoint of crustal stress evaluation; namely, (i) basic type, (ii) longitudinal-crack-bypass type, and (iii) depth-proportional type.

(i) Basic type evaluation

It is assumed that one of major crustal stresses is vertical (vertical assumption). The crustal stress is evaluated by the following equations which relate to the longitudinal cracks.

$$P_{sb} = -3\sigma_h + \sigma_H - P_o \quad (1)$$

$$\sigma_h = -P_s \quad (2)$$

here, $\sigma_H$, and $\sigma_h$ are principal stresses on a horizontal plane ($|\sigma_H| > |\sigma_h|$), and $P_o$ is a pore pressure.

(ii) Longitudinal-crack-bypass evaluation

Referring to FIG. 4, the method of this type evaluation extends the longitudinal cracks beyond the packer 5, and the measurement is taken while causing leak of water from the above-mentioned isolated portion, which is pressurized, to a non-pressurized portion. In this case, the above equation (2) is replaced with the following equation.

$$\sigma_h = -fP_s \quad (3)$$

here, f is a coefficient which is determined by laboratory experiments and numerical simulation, and its value is usually 0.6.

(iii) Depth-proportional type evaluation

The crustal stresses are assumed to be distributed in proportion to the depth (depth-proportionality assumption), and the proportionality coefficients are determined based on a large number of measured data on the pressures $P_s$ and $P_{sb}$.

In reality, however, the crustal stress is affected by various subsurface conditions, or geological structural conditions, and both of the above vertical assumption of the (i) basic type evaluation and the depth-proportional assumption of the (iii) depth-proportional type evaluation are not necessarily appropriate. Especially, in zones where considerable underground crustal movement is present, such as the circum-pacific zone and Mediterranean coastal zone, and in geothermal zones where thermal stresses prevail, the above two assumptions are not realistic.

The above-referred (ii) longitudinal-crack-bypass type evaluation does not use any assumptions which predetermine certain strain conditions, but in order to fully determine crustal stresses at a given depth by this type evaluation, two bore-holes with different inclinations and hydraulic fracturing data at two portions of each bore-hole are necessary. Thus, this type evaluation is quite costly and requires a large amount of labor and time. In short, the longitudinal-crack-bypass type evaluation is unrealistic and is not practicable except cases where tunnel wall is available for combined use with shallow small-diameter bore-holes for desired measurement.

SUMMARY OF THE INVENTION

Therefore, an object of the invention is to obviate the above-mentioned limitation of the prior art by providing an improved method for measuring crustal stress through hydraulic fracture of deep portions of a bore-hole. The method of the invention facilitates measurement of distribution of crustal stresses by hydraulically fracturing inner wall of a deep bore-hole.

As pointed out above, there have not been any practicable methods for measuring and evaluating crustal stress distribution at a deep location without using any assumptions on the crustal stress distribution itself.

The method of the invention allows the measurement of crustal stress at a deep spot without using any assumptions on crustal stress distribution. Data on crustal stress distribution is essential in various technical fields; such as designs of underground systems for extracting geothermal energy, underground petroleum storage systems, nuclear waste disposal, study of earthquake focal mechanism, and the earthquake prediction. The invention provides a development of basic techniques in the above technical fields.

A method of measuring crustal stress according to the invention comprises seven steps. In first step of the method, a bore-hole is drilled to a desired depth. Second step is to select a portion of the bore-hole for hydraulic fracturing and to form a horizontal prenotch thereat. To facilitate the selection of the portion for hydraulic fracture, the conditions of the inside surface of the bore-hole is carefully inspected by using at least one of the following checks; namely, checking of core samples which are obtained by the bore-hole drilling, checking of the bore-hole diameter, stratal checking by sonic wave, and checking by a bore-hole televiewer.

Third step of the method of the invention is to produce a longitudinal crack with or without a natural horizontal crack by isolating a portion of the bore-hole with a packing means such as a straddle packer, which portion is adjacent to but does not include the above-mentioned prenotch. High-pressure water is delivered to the isolated portion for the hydraulic fracturing. In fourth step, a portion including the above prenotch is isolated by a packing means such as a straddle packer and high-pressure water is delivered thereto so as to produce an artificial traverse crack while using the prenotch as nucleus of the crack. Instead of the artificial traverse crack, a natural traverse crack may be produced. Fifth step is to determine the orientation of each of the cracks thus produced by inspecting the configuration of the inside surface of the bore-hole. The inspection is made by using a suitable means, such as a bore-hole televiewer and an impression packer which molds the inside surface configuration.

Sixth step of the method of the invention is to measure micro-crack-initiating pressures $P_f$, crack-opening pressures $P_{sb}$, and shut-in pressures $P_s$ for the longitudinal crack and natural and/or artificial traverse crack through monitoring of the variation of the hydraulic pressure with time elapse, which hydraulic pressure is delivered from the high-pressure pump during the production of the cracks. Finally, seventh step determines major crustal stresses through numerical analysis of the thus measured orientations of the cracks and the thus measured hydraulic pressures.

BRIEF DESCRIPTION OF THE DRAWINGS

For a better understanding of the invention, reference is made to the accompanying drawings, in which.

Figure 1:
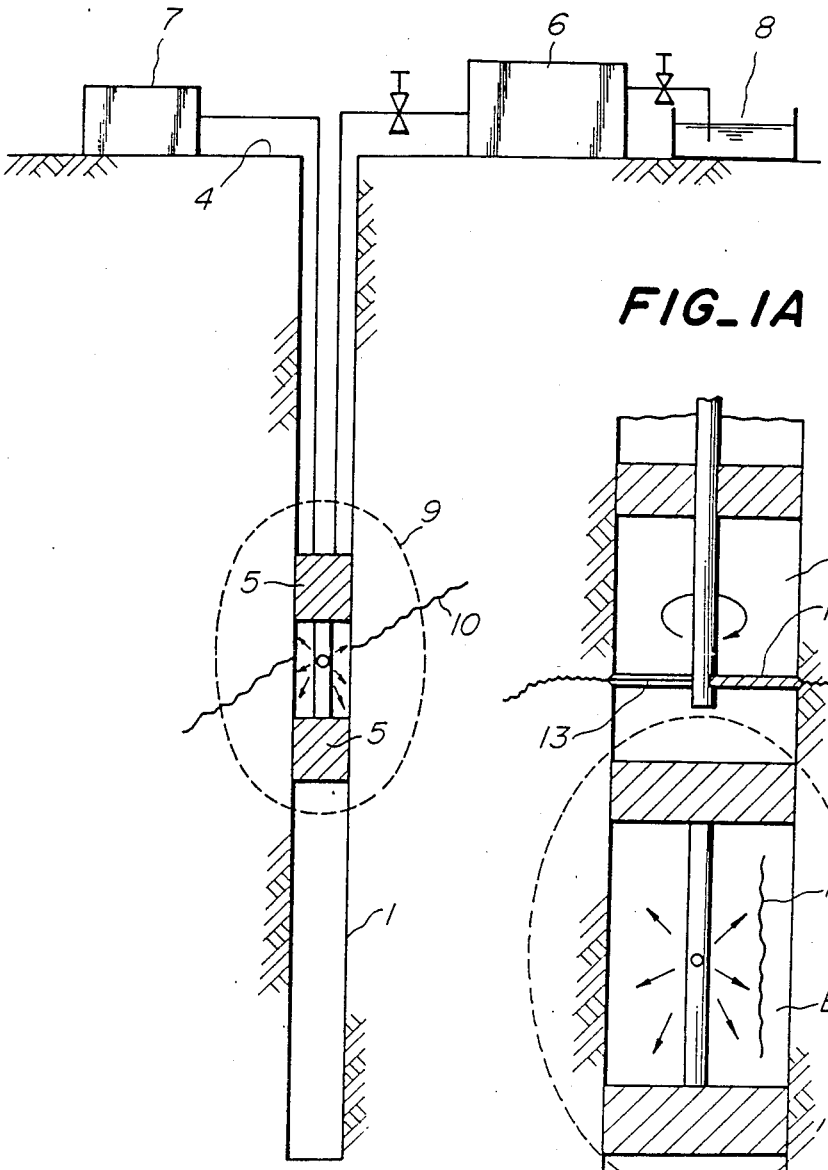
FIG. 1 is a schematic illustration of a method of measuring crustal stress according to the invention.

Throughout different views of the drawings, 1 is a bore-hole, 1*a* is bottom surface of the bore-hole, 1*b* is sidewall of the bore-hole, 2 is an over-coring hole, 3 is a strain gauge, 4 is ground surface, 5 is a packer (plug), 6 is a high-pressure pump, 7 is a measuring device, 8 is a water tank, 9 is a straddle packer (plug), 10 is a crack, 11 is a longitudinal crack, 12 is a traverse crack, 13 is a prenotch, 14 is a micro crack, 15 is a cutter, P is water pressure in the bore-hole, $P_o$ is pore pressure, $P_b$ is breakdown pressure for initiating sudden increase of a crack, $P_{sb}$ is crack reopening pressure for longitudinal crack, $P_s$ is shut-in pressure for longitudinal crack, $P_f$ is micro-crack-initiating pressure, $P_{sbn}$ is crack-reopening pressure for natural traverse crack, $P_{sn}$ is shut-in pressure for natural traverse crack, $P_{sba}$ is crack-reopening pressure for artificial traverse crack, $P_{sa}$ is reopening pressure for artificial traverse crack, $\sigma_i$ ($\sigma_1$, $\sigma_2$, $\sigma_3$) is principal crustal stress, $\sigma_t$ is maximum normal stress on the inside surface of the bore-hole v is Poisson's ratio of rock body, $\sigma_{ij}$ is crustal stress, $x_1$, $x_2$, $x_3$ (Z) are axes of a Cartesian coordinate system, (r, $\theta$, z) is a cylindrical coordinate system $\theta_o$ is a circumferential angular position (orientation) where a longitudinal crack is initiated, $\theta$ is a circumferential angular position (orientation) where reopening of a natural traverse crack is initially produced, $\theta_a$ is a circumferential angular position (orientation) where reopening of an artificial traverse crack is initially produced, $n_i$ is the direction cosine of a normal vector to a crack surface, $\overline{\sigma_1}$ is minimum vertical stress on a horizontal plane, $\overline{\sigma_2}$ is maximum vertical stress on a horizontal plane, and $\alpha$ is an angle between the $\sigma_3$ direction and a vertical.

DESCRIPTION OF THE PREFERRED EMBODIMENT

A method of measuring crustal stress according to the present invention will be explained now by referring to an embodiment which is illustrated in the drawing.

FIG. 1 schematically shows a hydraulic system for effecting rock fracture as an essential step of the method of the invention. In the figure, a bore-hole 1 is drilled from the ground surface 4 to a desired depth. A pair of packers (plugs) 5 are disposed at a selected portion of the bore-hole 1. High-pressure water is introduced from a high-pressure pump 6 to the space between the two packers 5. When the hydraulic pressure of the high-pressure water is applied to the pair of packers 5, they are tightly urged against the inside surface of the bore-hole 1, and the space therebetween is isolated from the rest of the bore-hole 1. The magnitude of the hydraulic pressure in the isolated space between the two packers 5 is monitored by a measuring device 7 which is connected to the isolated space. A water tank 8 is provided to supply water to the high-pressure pump 6. The reference numeral 9 shows that the two packers 5 can be used as a straddle packer unit for defining an isolated space therebetween.

Figure 2A:
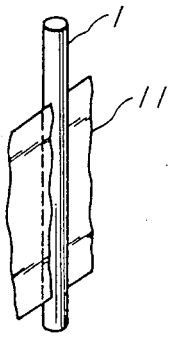
FIG. 2 shows two schematic perspective views illustrating a longitudinal crack and a traverse crack respectively.
Figure 2B:
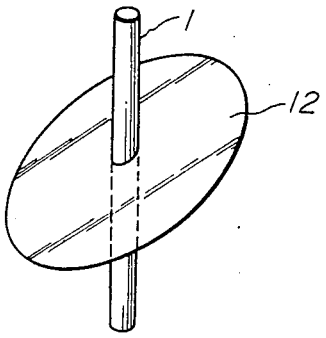
Figure 3:
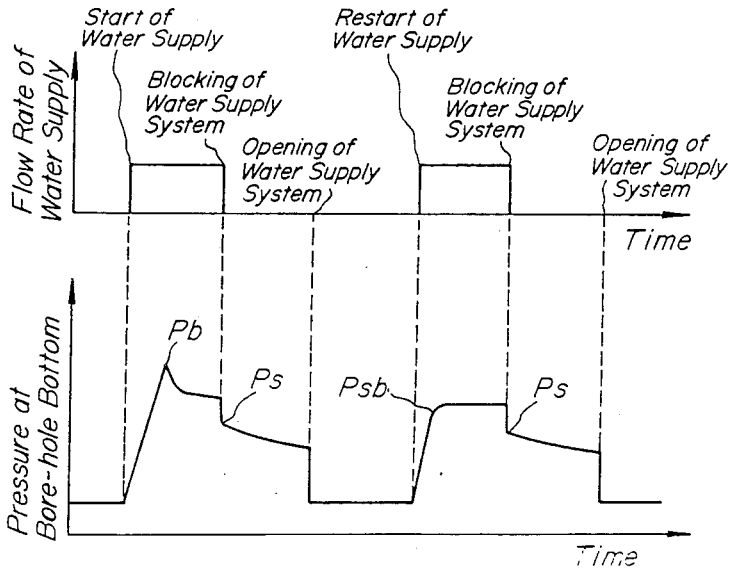
FIG. 3 is a graph showing the variation of water pressure with time elapse during hydraulic fracturing.
Figure 4:
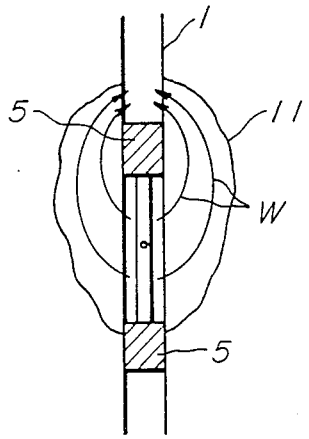
FIG 4 PRIOR ART
FIG. 4 is a schematic illustration of longitudinal-crack-bypass type evaluation method of the prior art for measuring crustal stresses.

A crack 10 will be produced in the rock around the space between the packers 5 as the hydraulic pressure there increases in excess of a certain value. FIG. 2(*a*) shows a longitudinal crack 11 which extends in the length direction of the bore-hole 1, while FIG. 2(*b*) shows a traverse crack 12 which intersects the bore-hole 1.

The method of the invention determines the crustal stress based on the orientations of the cracks 11 and 12 thus produced and the hydraulic pressures at different states of the crack production. Different steps of the method of the invention for measuring the crustal stress will be described in the order of their execution.

(1) Hydraulic fracturing (1-1) The bore-hole 1 is drilled to the desired depth.

(1-2) The condition of the inside surface of the bore-hole 1 is inspected and a portion of the bore-hole 1 to be fractured by the hydraulic pressure is selected based on the inspection. The inspection is made by the checking of core samples obtained during the drilling of the bore-hole, checking of the hole diameter, checking with sonic wave, and/or checking by a bore-hole televiewer.

Figure 1A:
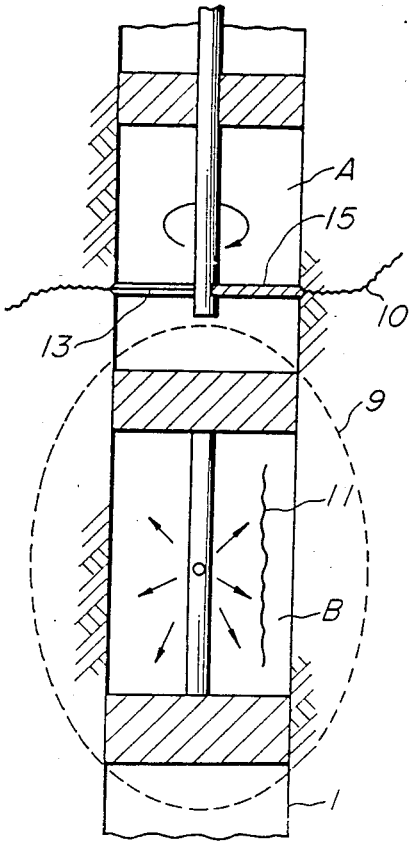
FIG. 1A is a partial schematic sectional view of a bore-hole on which a longitudinal crack and a prenotch are formed in the method of the invention.

(1-3) A horizontal prenotch 13 is formed in the above-mentioned portion as shown in FIG. 1A. The prenotch 13 can be made either by turning a cutter 15 so as to cut a horizontal annular notch on the inside surface of the bore-hole 1, or by forming a similar annular notch by a water jet.

Figure 5:
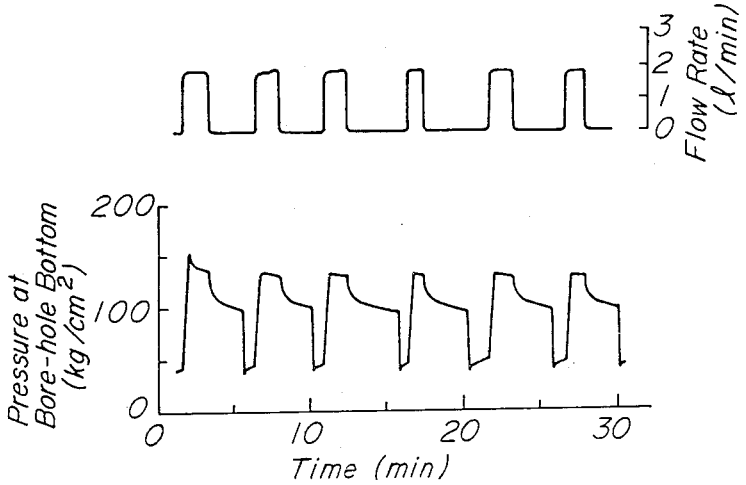
FIG. 5 is a graph showing the variations of flow rate and water pressure in the case of Higashi Hachimantai Test Field experiment.

(1-4) A portion of the bore-hole 1 which is adjacent to the above portion with the prenotch is isolated by placing a straddle packer thereacross. High-pressure water is delivered to the thus isolated portion from the high-pressure pump 6 in a cyclic manner until a longitudinal crack 11 is produced. The cyclic delivery of the high-pressure water is repeated several times. FIG. 5 shows an actual example of the variation of the hydraulic pressure with time elapse during the cyclic delivery of the high-pressure water.

(1-5) The above-mentioned portion with the prenotch is isolated from the rest of the bore-hole 1 by placing the straddle packer 9 thereacross. The high-pressure water is delivered to the thus isolated portion in a manner similar to the preceding step (1-4), and an artificial traverse crack is produced while using the prenotch 13 as a nucleus thereof.

(1-6) The orientations of the cracks thus formed in the steps (1-4) and (1-5) are determined by inspecting the inside surface of the above portions by using a bore-hole televiewer and/or an impression packer which molds the configuration of the inside surface.

It is noted here that if the rock body should have an intrinsic weak plane which traverses the bore-hole 1, a natural traverse crack may be formed in the above step (1-4) and/or (1-5).

(2) Evaluation of crustal stress by using the result the hydraulic fracturing

Fundamental equations necessary for the evaluation will be explained now. In the ensuing description, it is understood that suffixes 1, j assume values 1, 2 and 3. Principal crustal stress is represented by $\sigma_1$, $|\sigma_1| > |\sigma_2| > |\sigma_3|$.

Figure 6:
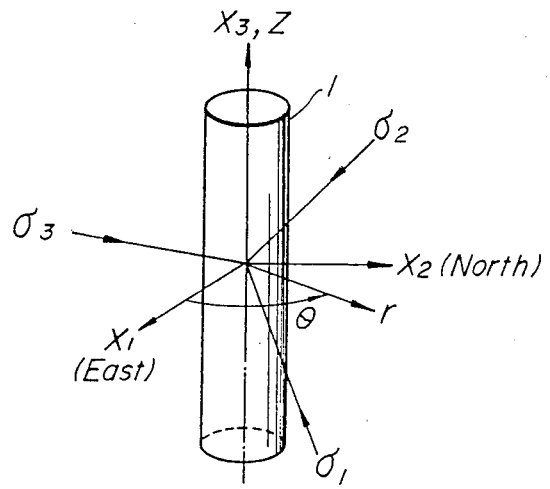
FIG. 6 is an explanatory diagram of coordinate systems which are used in the analysis of stresses in a bore-hole.

FIG. 6 shows a Cartesian coordinate system O-$x_1$, $x_2$, $x_3$ with the axis $x_3$ aligned with the longitudinal central axis of the bore-hole 1 and cylindrical coordinates O-r, $\theta$, z, which coordinate system and coordinates are used in the analysis of the invention.

When the hydraulic pressure in the bore-hole 1 is represented by P and the Poisson's ratio of the rock is represented by v, the cylindrical stress components on the surface of the bore-hole are given by the crustal stresses $\sigma_{ij}$ as follows:

$$\left.\begin{aligned}
&\sigma_r = -P \\
&\sigma_\theta = \sigma_{11} + \sigma_{22} - 2(\sigma_{11} - \sigma_{22})\cos 2\theta - 4\sigma_{12}\sin 2\theta + P \\
&\sigma_z = \sigma_{33} - v\{2(\sigma_{11} - \sigma_{22})\cos 2\theta + 4\sigma_{12}\sin 2\theta\} \\
&\sigma_{\theta z} = 2(\sigma_{23}\cos\theta - \sigma_{13}\sin\theta) \\
&\sigma_{r\theta} = \sigma_{rz} = 0
\end{aligned}\right\} \quad (4)$$

As to cracks to be produced by the hydraulic fracturing operation, there are longiudinal cracks and traverse cracks. Of the traverse cracks, artificial traverse cracks are formed along the above-mentioned annular prenotch while natural traverse cracks are formed at an intrinsic weak plane of the rock body. Fundamental equations for each kind of cracks will be discussed now in detail.

Longitudinal Cracks

Maximum normal stress $\sigma_t$ on the surface of the bore-hole is given by $$\sigma_t = (\tfrac{1}{2})\{\sigma_\theta + \sigma_z + \sqrt{(\sigma_\theta - \sigma_z)^2 + 4\sigma_{\theta z}^2}\} \tag{5}$$

Figure 7:
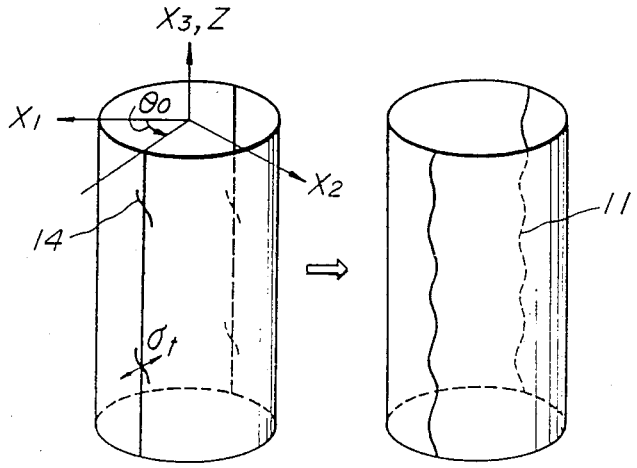
FIG. 7 is an illustration of the relationship between initiation of micro cracks and formation of longitudinal cracks.

Fine cracks perpendicular to $\sigma_t$ are produced where $\sigma_t$ is maximized. With the increase of the water pressure, the micro cracks grow and combine with each other and longitudinal cracks are produced as shown in FIG. 7. If the angular position where the longitudinal crack is produced is represented by $\theta_0$ and the tensile strength of the rock body is represented by T, then the crustal stress satisfies the following relations.

$$\left.\frac{\partial \sigma_t}{\partial \theta}\right|_{\theta = \theta_0,\ P = P_f} = 0 \tag{6}$$

$$\sigma_t|_{\theta = \theta_0,\ P = P_f} + P_0 = T \tag{7}$$

Here, $P_f$ represents micro-crack-initiating pressure, i.e., the pressure at which a fine crack is initially produced. This pressure $P_f$ can be detected during the first delivery of high-pressure water as a point where the pressure increase becomes non-proportional to the elapse of time. The reopening of the crack occurs when the rock component of the stress $\sigma_\theta$ becomes zero; namely, $$\sigma_\theta|_{\theta=\theta_0,\ P=P_{sb}} + P_0 = 0 \tag{8}$$

Figure 8:
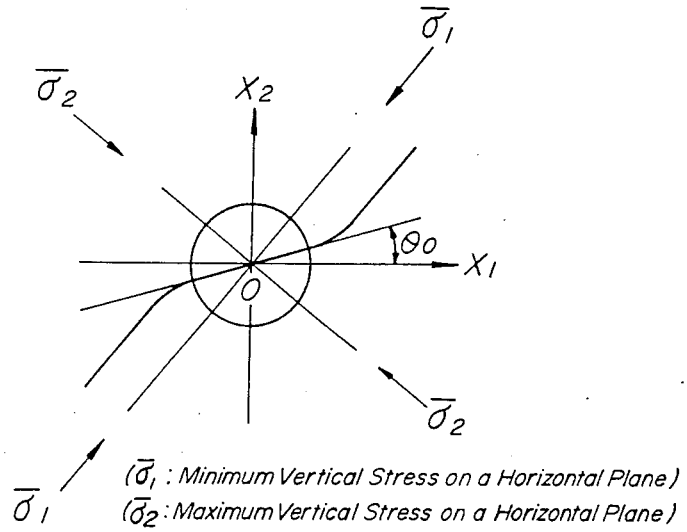
FIG. 8 is a diagrammatic illustration of the growth of a longitudinal crack.

As the longitudinal crack grows, the plane of the longitudinal crack becomes a plane that is perpendicular to the minimum compressive stress on that plane which is perpendicular to the axis of the bore-hole, as shown in FIG. 8. Accordingly, the shut-in pressure $P_s$ satisfies the following equation.

$$\overline{\sigma_2} = -P_s \tag{9}$$

here, $$\overline{\sigma_2} = (\tfrac{1}{2})\{\sigma_{11} + \sigma_{22} + \sqrt{(\sigma_{11} - \sigma_{22})^2 + 4\sigma_{12}^2}\} \tag{10}$$

Natural Traverse Crack

If the rock body has an intrinsic weak plane which intersects the pressurized portion of the bore-hole, a natural traverse crack is produced along the weak plane. The reopening of such natural traverse crack occurs when the rock bearing fraction of a vertical stress $S_n$ perpendicular to the plane of the crack becomes zero, namely when the following relations is satisfied on the wall of the bore-hole.

$$S_n|_{\theta = \Theta,\ P = P_{sbn}} + P_0 = 0 \tag{11}$$

$$\left.\frac{\partial S_n}{\partial \theta}\right|_{\theta = \Theta,\ P = P_{sbn}} = 0 \tag{12}$$

Here, $P_{sbn}$ represents the crack reopening pressure for the natural traverse crack, and $\theta$ represents the circumferential angular position (orientation) where reopening of a natural traverse crack is initially produced. The vertical stress $S_n$ is given by $$S_n = \sum_{\substack{i,j \\ (i \geqq j)}}^{3} b_{ij}(\theta)\sigma_{ij} + B(\theta)P \tag{13}$$

Here, $b_{ij}(\theta)$ and $B(\theta)$ are known functions of $\theta$ which are expressed in terms of direction cosines ($n_i$) of normal vectors to the crack plane. When the system for supplying the high-pressure water is closed (shut-in), the water pressure balances that component of the crustal stress which is in a direction perpendicular to the crack plane: namely, $$S_{on} = -P_{sn} \tag{14}$$

Here, $P_{sn}$ is the shut-in pressure for a natural traverse crack, and $S_{on}$ is given by $$S_{on} = \sum_{\substack{i,j \\ (i \geqq j)}}^{3} C_{ij}\sigma_{ij} \tag{15}$$

Here, $C_{ij}$ is a known coefficient which is expressed in terms of $n_i$.

Artificial Traverse Crack

When a traverse crack is produced with the horizontal annular prenotch as the nucleus thereof, the crack grows substantially horizontally in the initial stage of the hydraulic fracturing. Then, as the total amounnt of the high-pressure water in the pressurized portion increases, the crack becomes perpendicular to the minimum compressive stress of the crustal stress. Accordingly, in the initial stage, the crustal stress can be expressed in terms of the shut-in pressure $P_{sa}$ for the artifical traverse crack in the following manner.

$$\sigma_{33} = -P_{sa} \tag{16}$$

After supplying a sufficient amount of high-pressure water, $$\sigma_3 = -P_{sa} \tag{17}$$

There are following relationships concerning the crack reopening pressure $P_{sba}$.

$$S_n|_{P = P_{sba},\ \theta = \Theta_a} + P_0 = 0 \tag{18}$$

$$\left.\frac{\partial S_{na}}{\partial \theta}\right|_{P = P_{sba},\ \theta = \Theta_a} = 0 \tag{19}$$

Here, $\theta_a$ is a circumferential angular position (orientation) where reopening of an artificial traverse crack is initially produced, and $S_{na}$, given by the following equation (20), represents the value of a stress perpendicular to the crack plane on the inside surface of the bore-hole.

$$S_{na} = \sum_{\substack{i,j \\ (i \geqq j)}}^{3} d_{ij}(\theta)\sigma_{ij} + D(\theta)P \tag{20}$$

Here, $d_{ij}(\theta)$ and $D(\theta)$ are functions of $\theta$, which represent the intensity of stress concentration at the tip of the prenotch and such functions are known when the shape of the prenotch is definite.

The fundamental equations which have been described above facilitate the evaluation of the crustal stress based on data covering both various kinds of pressures measured during the production of the three types of cracks and the orientations of the cracks. The above pressures are measured from the variation of the water pressure during the fracturing operation, while the above orientations are measured by using a bore-hole televiewer and/or a impression packer that molds the configuration of the inside surface of the fractured bore-hole. The data items which can be measured in the manner described above are summarized in Table 1.

TABLE 1

| Type of crack | Data extractable from measured record: Items being measured and recorded | Data extractable from measured record: Data extractable from measured record |
|---|---|---|
| Longitudinal (L) | Variation of hydraulic pressure with time elapse | $P_f$<br>$P_{sb}$<br>$P_s$ |
| | Checking by impression packer or bore-hole televiewer | $\theta_0$ |
| Natural traverse (TN) | Variation of hydraulic pressure with time elapse | $P_{sbn}$<br>$P_{sn}$ |
| | Checking by impression packer or bore-hole televiewer | $n_i$ |
| Artificial traverse (TA) | Variation of hydraulic pressure with time elapse | $P_{sba}$<br>$P_{sa}$ |

*Artificial
$P_f$: micro-crack-initiating pressure
$P_{sb}$: crack reopening pressure
$P_s$: shut-in pressure
$\theta_0$: circumferential angular position (orientation) where a longitudinal crack is initiated
$P_{sbn}$: crack reopening pressure for natural traverse crack
$P_{sn}$: crack shut-in pressure for natural traverse crack
$n_i$: direction cosine of a normal vector to a crack surface
$P_{sba}$: crack reopening pressure for artificial traverse crack
$P_{sa}$: shut-in pressure for artificial traverse crack As shown in Table 1, the longitudinal crack, the natural traverse crack, and the artificial traverse crack will be abbreviated as L, TN, and TA respectively hereinafter.

The method for evaluating the crustal stress from the above-mentioned data will be described now case by case depending on the types of cracks produced.

Case I: Data on L and TN are availble

There are seven unknowns, i.e., $\sigma_{ij}$ ($\sigma_{ij}=\sigma_{ji}$) and $\theta$, which can be determined by seven equations (6), (7), (8), (9), (11), (12), and (14).

Case II: Data on L and TA are available

There are seven unknowns, i.e., $\sigma_{ij}$ ($\sigma_{ij}=\sigma_{ji}$) and $\theta_a$, which can be determined by seven equations (6), (7), (8), (9), (16) (or (17)), (18), and (19).

Case III: Data on L, TA and TN are available

To be divided into Case III-1 and Case III-2 depending on whether the prenotch shape is definite or not.

Case III-1: The prenotch shape is definite and $d_{ji}(\theta)$ and $D(\theta)$ of equation (20) are known. There are eight unknowns, i.e., $\sigma_{ij}$ ($\sigma_{ij}=\sigma_{ji}$), $\nu$, and $\theta_a$, which can be determined by eight equations (8), (9), (11), (12), (14), (16) (or (17)), (18), and (19).

Case III-2: The prenotch shape is not defined and $d_{ji}(\theta)$ and $D(\theta)$ of equation (20) are not known. There are eight unknowns, i.e., $\sigma_{ij}$ ($\sigma_{ij}=\sigma_{ji}$), $\theta$, and $P_f$, which can be determined by eight equations (6), (7), (8), (9), (11), (12), (14) and (16) (or (17)).

Figure 9:
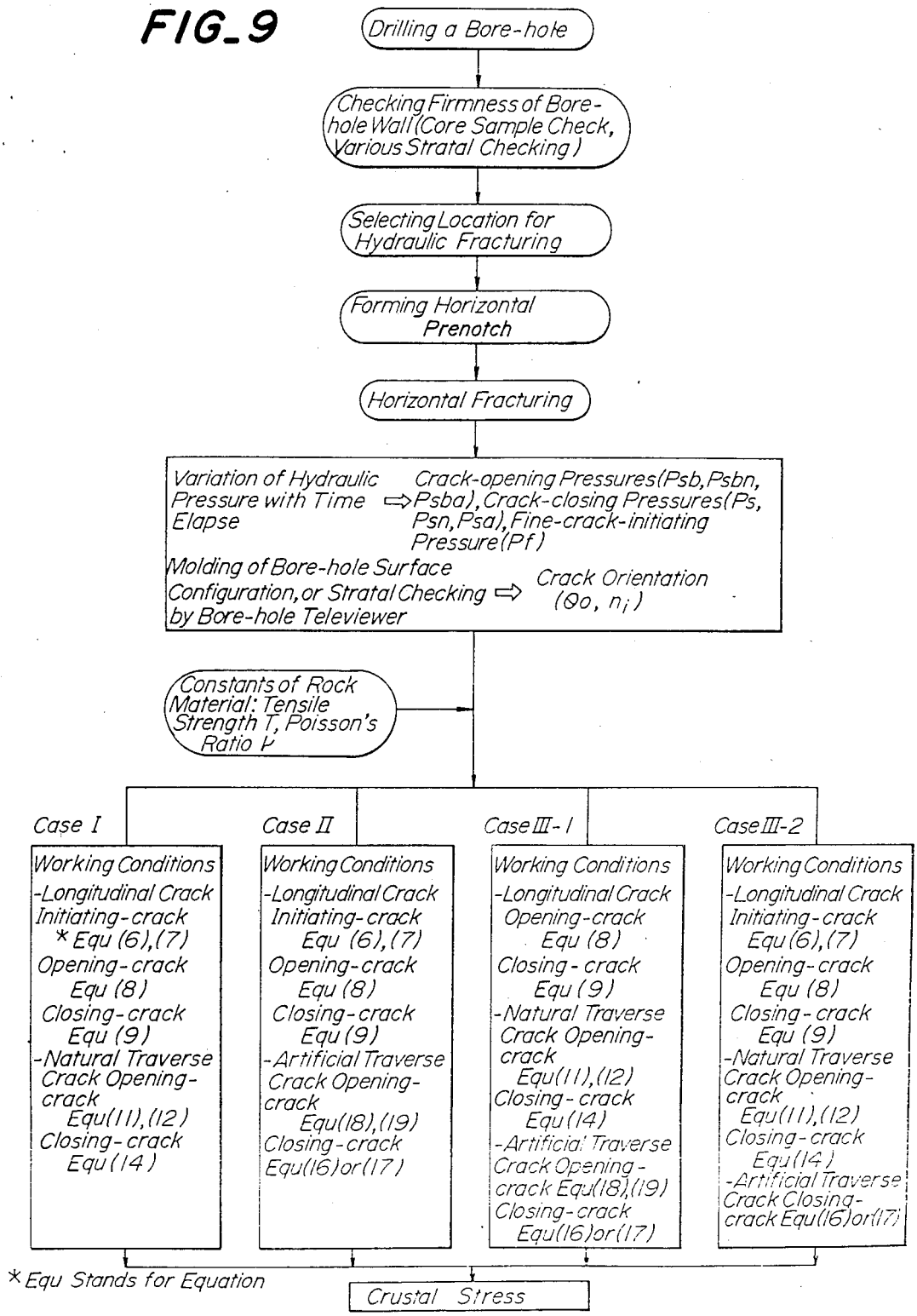
FIG. 9 is a flow chart of a process for determining crustal stress according to the present invention.

The process for measuring the crustal stress, which has been described above, is summarized in the form of a flow chart in FIG. 9. The method of the invention will now be described by referring to FIG. 9.

Step 1:

To drill a bore-hole 1.

Step 2:

To inspect the inside surface of the bore hole by checking core samples, checking through measurement of bore-hole diameter, checking with sonic wave, and/or checking with a bore-hole televiewer, and to select a portion A (FIG. 1A) of the bore-hole for applying hydraulic fracturing, i.e., to select a sturdy portion of the bore-hole inside surface.

Step 3:

To form a horizontal prenotch 13. Although FIG. 1A shows a rotary cutter 15 for making the prenotch 13, jetting of pressurized water (water jet) or any other suitable method can be used to form it.

Step 4:

To place a straddle packer 9 in the portion B (FIG. 1A) of the bore-hole 1, which portion is adjacent to but does not include the prenotch 13, and supply high-pressure water there from the high-pressure pump 6 so as to produce a longitudinal crack 11. The high-pressure water supply is repeated several times in a cyclic manner as shown in FIG. 5. Then, the straddle packer is moved to the portion A having the prenotch 13, and the high-pressure water is supplied thereto in a similar manner so as to produce an artificial traverse crack 10. A natural traverse crack may or may not be produced in the portion A or B.

To watch the variation of pressure of the high-pressure pump 6, so as to find the crack reopening pressures ($P_{sb}$, $P_{sbn}$, $P_{sba}$), shut-in pressures ($P_s$, $P_{sn}$, $P_{sa}$), and micro-crack-initiating pressure $P_f$.

To inspect the inside surface of the bore-hole 1, after the crack production, with a bore-hole televiewer or a impression packer which molds the surface configuration, so as to find the orientations ($\theta_o$, $n_i$) of the cracks produced. To analyze the data thus measured while using rock body constants, i.e., its tensile strength T and Poisson's ratio v, depending on the types of cracks produced as classified in Cases I, II, III-1, and III-2, so as to determine the crustal stress.

As shown in FIG. 9, Case I has a longitudinal crack and a natural traverse crack, Case II has a longitudinal crack and an artificial traverse crack, Case III-1 has a longitudinal crack and a natural traverse crack and an artificial traverse crack with a clearly defined prenotch, and Case III-2 has a longitudinal crack and a natural traverse crack and an artificial traverse crack with a vague prenotch.

Depending on the case, seven or eight simultaneous non-linear equations which are listed in FIG. 9 are solved by a suitable numerical method, and the crustal stresses are determined.

In the equations (11), (12), and (14), $P_{sbn}$ represents crack reopening pressure for the natural traverse crack and the suffix n stands for "natural". In the equations (16) through (19), $P_{sa}$ represents the shut-in pressure for the artificial crack, and the suffix a stands for "artificial". Similarly, $P_{sba}$ represents the crack reopening pressure for the artificial traverse crack.

[Experiment]

Figure 10:
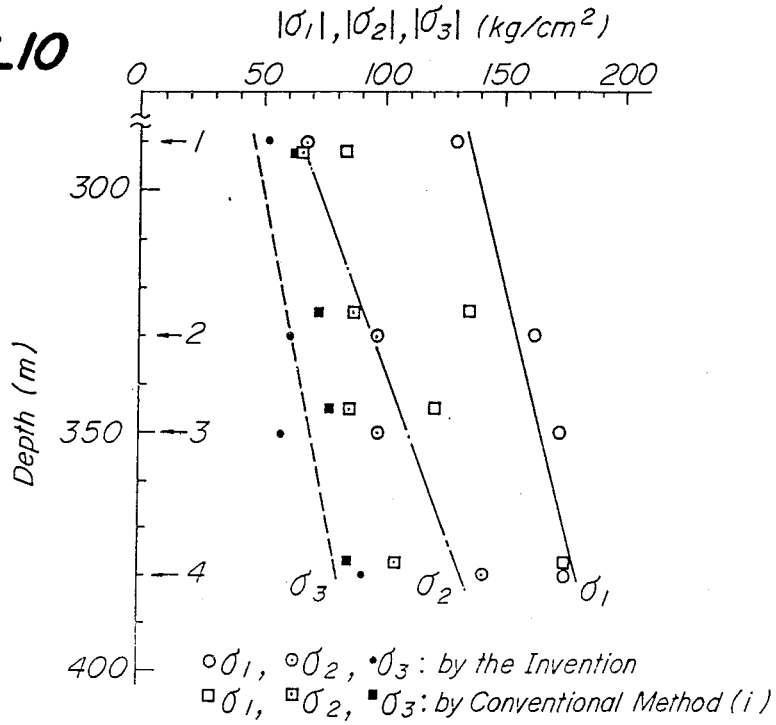
FIG. 10 is a graph showing the distribution of crustal stresses in the direction of depth for the case of Higashi Hachimantai Test Field experiment.
Figure 11:
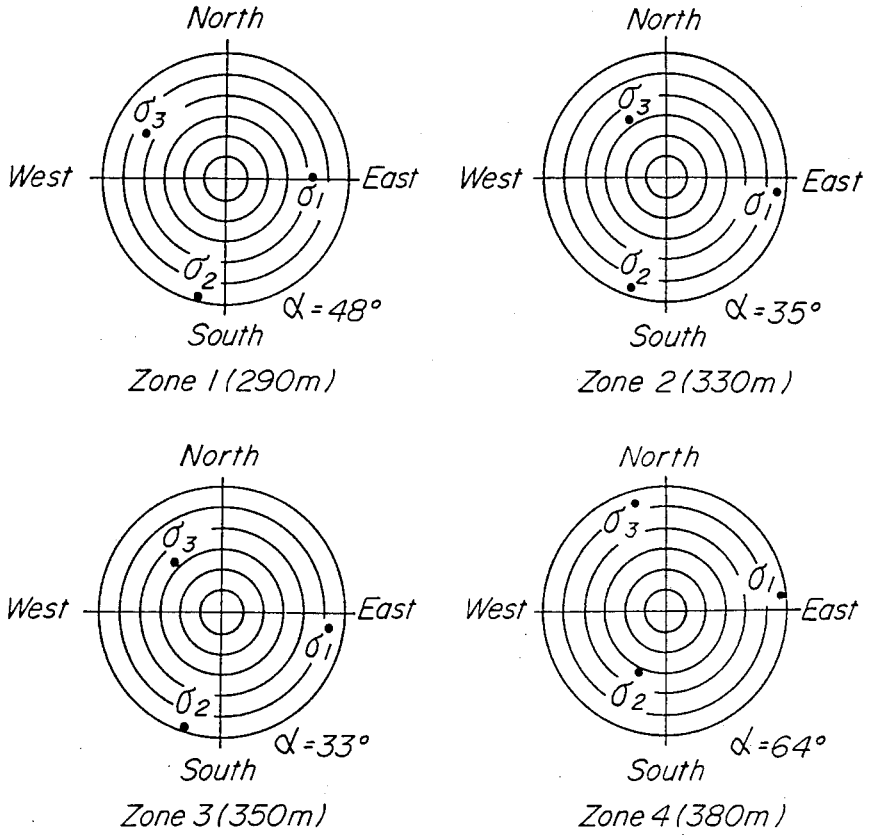
FIG. 11 is a graph showing the orientations of principal axes of crustal stresses in the case of Higashi Hachimantai Test Field experiment.
Figure 12:
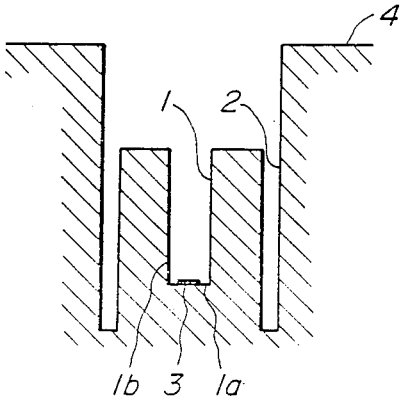
FIG. 12 PRIOR ART
FIG. 12 is a diagrammatic sectional view of a bore-hole, showing the operation of a conventional stress-release method for measuring crustal stress.

The inventors have carried out a field experiment of the method of the invention at Higashi Hachimantai Test Field of Tohoku University. Bore-holes of 500 m depth were drilled and four zones (zone 1 through 4) were defined in the bore-holes. A prenotch was formed in each zone, and the hydraulic fracture was effected two to three times. The result of the hydraulic fracture tests is shown in Table 2. FIG. 10 and FIG. 11 illustrate the result of crustal stress evaluation by the above-mentioned analytical method based on the data thus obtained. The method of Case I was used for the zone 1, 2 and 4, while the method of Case III-2 was used for the zone 3.

TABLE 2

| | | | Data of hydraulic fracturing experiment at Higashi Hachimantai Test Field | | | | | | | |
|---|---|---|---|---|---|---|---|---|---|---|
| | | | | | | | Hydraulic pressure*** | | | |
| Zone No. | Depth (m) | Crack type* | $\theta_0$ (deg.) | Direction cosine** $n_1$ | $n_2$ | $n_3$ | $P_f$ | $P_{sb}$ $P_{sbn}$ | $P_s$ $P_{sa}$ $P_{sn}$ | $P_b$ |
| 1 | 288.2 | L | −10.9 | — | — | — | 120 | 78 | 56 | 128 |
| | 290.5 | TN | — | 0.286 | 0.785 | 0.549 | — | 100 | 86 | — |
| | 293.3 | L | 9.6 | — | — | — | 126 | 84 | 72 | 137 |
| 2 | 325.5 | L | 6.4 | — | — | — | 131 | 103 | 87 | 143 |
| | 329 | TN | — | −0.040 | 0.790 | 0.612 | — | 62 | 70 | — |
| 3 | 345 | L | 9.3 | — | — | — | — | 104 | 86 | — |
| | 348.5 | TA | — | — | — | — | — | — | 86 | — |
| | 356.4 | TN | — | 0.350 | −0.899 | 0.262 | — | 131 | 117 | — |
| 4 | 377.5 | L | 11.5 | — | — | — | 146 | 110 | 107 | 158 |
| | 380.5 | TN | — | −0.221 | 0.949 | 0.227 | — | 76 | 78 | — |

*L: longitudinal crack
TN: natural traverse crack
TA: artificial traverse crack
**Direction cosine of normal vector to natural traverse crack
***Hydraulic pressure at the bottom of the bore-hole (kg/cm$^2$)

FIG. 10 shows the distribution of the crustal stresses with depth at the Higashi Hachimantai Test Field, while FIG. 11 shows the orientations of the principal axes of the crustal stresses there. The figures were drawn by the Wolf net projection while using projection of upper hemisphere, and $\alpha$ represents the angle between the direction of the crustal stress $\sigma_3$ and a vertical.

The following steps are essential in the method of measuring the crustal stress according to the invention.

(1) To form a horizontal prenotch on the inside surface of a bore-hole by a suitable means and to produce a traverse crack with the prenotch as the nucleus thereof.

(2) To obtain data from hydraulic fracturing tests at one or more portions of a bore-hole by the analytical method of either one of the above-mentioned four cases, i.e., Case I, Case II, Case III-1, and Case III-2, and to determine all components of the crustal stress at a selected depth.

As described in detail in the foregoing, the method of the invention determines crustal stress by measuring the variation of hydraulic pressure during hydraulic fracture of rock body and orientations of cracks produced by the fracture and numerically analyzing the thus measured pressure and crack orientations. Thereby, the invention eliminates the need of any specific assumptions, such as an assumption of the presence of at least one vertical principal crustal stress (verticality assumption) and an assumption of proportional increase of the crustal stress with depth (depth-proportionally assumption). Consequently, the invention facilitates very accurate determination of crustal stresses.

What is claimed is:

1. A method of measuring crystal stress by hydraulic fracture based on analysis of crack growth in rock comprising a first step of drilling a bore-hole to a desired depth;

a second step of selecting a prenotch portion ofthe bore-hole based on surface conditions thereof and forming a horizontal prenotch on inside surface of the prenotch portion;

a third step of producing a longitudinal crack in an other portion of the bore-hole by isolating said other portion by a packing means tightly engageable with the bore-hole and delivering high-pressure water to said other portion, said other portion being adjacent to the prenotch portion;

a fourth step of producing a traverse crack in the prenotch portion by isolating said prenotch portion by the packing means and delivering high-pressure water to the prenotch portion;

a fifth step of determining orientations of said longitudinal and traverse cracks by inspecting inside surface conditions of the prenotch and other portions of the bore-hole;

a sixth step of measuring pressure data, which data cover micro-crack-initiating pressures $P_f$, crack reopening pressures $P_{sb}$, and shut-in pressures $P_s$, by observing pressure variation of the high-pressure water during production of said cracks; and a seventh step of determining principal crustal stresses from said orientations and said pressure data by calculation.

2. A method of measuring crustal stress by hydraulic fracture as set forth in claim 1, wherein the surface conditions of the bore-hole is inspected in said second step by checking of core samples which are obtained by the bore-hole drilling, checking of the bore-hole diameter, checking by sonic wave, and/or checking by a bore-hole televiewer.

3. A method of measuring crustal stress by hydraulic fracture as set forth in claim 1, wherein the packing means is a straddle packer having a pair of spaced packer elements which are tightly engageable with the inside surface of the bore-hole.

4. A method of measuring crustal stress by hydraulic fracture as set forth in claim 1, wherein a natural traverse crack is formed in said other portion of the bore-hole simultaneously with the longitudinal crack in said third step and the major crustal stresses are determined while considering data concerning the natural longitudinal crack.

5. A method of measuring crustal stress by hydraulic fracture as set forth in claim 1, wherein the traverse crack produced in the fourth step is an artificial traverse crack which is formed while using the prenotch as a nucleus thereof.

6. A method of measuring crustal stress by hydraulic fracture as set forth in claim 1, wherein the traverse crack produced in the fourth step is a natural traverse crack which is irrelevant to the prenotch.

7. A method of measuring crustal stress by hydraulic fracture as set forth in claim 1, wherein traverse cracks are produced in the fourth step, which traverse cracks include an artificial traverse crack that is formed while using the prenotch as a nucleus thereof and a natural traverse crack that is irrelevant to the prenotch fracture.

8. A method of measuring crustal stress by hydraulic fracture as set forth in claim 1, wherein the inside surface conditions of the bore-hole is inspected in said fifth step for determining the crack orientations by using a bore-hole televiewer and/or a molding pack which molds configuration of the bore-hole inside surface.

* * * * *